United States Patent [19]

Cresswell

[11] 4,175,695

[45] Nov. 27, 1979

[54] FAIL-SAFE STACK DAMPER CONTROL SYSTEM

[76] Inventor: Don E. Cresswell, Dubbs Rd., Sparks, Md. 21152

[21] Appl. No.: 896,482

[22] Filed: Apr. 14, 1978

[51] Int. Cl.[2] ..... F23N 3/00

[52] U.S. Cl. ..... 236/1 G; 236/68 R; 431/20

[58] Field of Search ..... 236/1 G, 68 R; 126/285 B; 431/20; 251/11

[56] References Cited

U.S. PATENT DOCUMENTS

| | | | |
|---|---|---|---|
| 1,300,990 | 4/1919 | Meacham | 236/10 |
| 2,095,951 | 4/1937 | McCabe | 236/68 R X |
| 2,118,299 | 5/1938 | Ellis | 137/79 |
| 2,154,644 | 4/1939 | Sweatt | 236/1 G |
| 2,155,642 | 4/1939 | Dewey | 236/1 G |
| 2,633,299 | 3/1953 | Brown, Jr. | 236/1 G |
| 2,761,494 | 9/1956 | Field | 431/20 |
| 2,856,992 | 10/1958 | Bartels | 158/28 |
| 3,050,601 | 8/1962 | Bohn | 236/68 R X |
| 3,197,139 | 7/1965 | Diermayer et al. | 236/1 G |
| 4,046,318 | 9/1977 | Ripley | 236/1 G |

FOREIGN PATENT DOCUMENTS

| | | | |
|---|---|---|---|
| 1010366 | 11/1965 | United Kingdom | 236/1 G |

*Primary Examiner*—William F. O'Dea
*Assistant Examiner*—William E. Tapolcai, Jr.
*Attorney, Agent, or Firm*—John F. McClellan, Sr.

[57] ABSTRACT

An improved flue damper for isolating furnace from chimney-flue when burner is not operating includes in preferred embodiment a damper plate pivotally mounted within a flue section on a control rod extending through the flue section to bearing support in a bracket spaced from the flue section by a frame affixed to the flue section exterior; a bimetallic strip spiral having inner end affixed on the control rod and outer end detachably looped over a stud extending from the frame rotates the control rod under thermal actuation provided by an electric heating element adjacent the bimetallic strip spiral; a damper control strip on the end of the control rod adjustably affixes a switch plate rotatable therewith and bearing a first mercury switch controlling the heating element circuit and a second mercury switch controlling the furnace burner circuit; stop structure on the bracket limits rotation of the damper control strip and control rod.

12 Claims, 4 Drawing Figures

FAIL-SAFE STACK DAMPER CONTROL SYSTEM

This invention relates generally to heating systems and specifically to improvement in energy conservation in thermal systems.

It is known that combustion furnaces lose much heat up the flue when not operating, and numerous devices have been disclosed for preventing such losses, having pertinence to which are the following:

British Pat. No. 1,010,366 to A. Diermeyer, 5-28-63, discloses bimetallic element actuating damper, interlock and heating circuit for bimetallic element, and mercury switch carried by the damper;

U.S. Patent Nos. 1,300,990 to B. E. Meacham, 4-15-19, discloses stack damper actuated by thermostat;

2,118,299 to O. W. Ellis, 5-24-38 discloses bimetallic elements for sealing;

2,154,644 to C. B. Sweatt, 4-18-39, discloses combustion device with pivotal stack damper carrying on the pivotrod a mercury switch for interlocking, and associated in circuit with this switch a bimetallic element with electric heater;

2,155,642 to R. P. Dewey, 4-25-39, represents a large number of patents in which a motor drives a stack damper;

2,856,992 to A. H. Bartels, 10-21-58, discloses a time-delay feature, in a stack damper having solenoid drive, of which numerous examples appear;

3,197,139 to A. Diermayer et al, 7-27-65, discloses a bimetallic element directly operating a flue damper carrying a switch, with control circuits including a circuit directly heating the bimetallic element by resistance. The mercury switches described "may be replaced by other switches responsive to the position of bracket 10 or damper 9".

However, in the fuel oil crisis now threatening to subject the United States economy to the whim of outsiders, and to that extent to remove the independence of the United States, and in any event to cause domestic privation; every improvement in oil and gas and other energy conservation is especially significant.

Objects therefore of the present invention are to provide an elementally simple stack damper and control which is at the same time more efficient, safer, easier to install, more resistant to damage and malfunction, and more economical in materials and in operation than prior known devices, and which has operation so easily understood, that in total combination of these advantages it will encourage the immediate installation and continued use of this system in large numbers throughout the United States, and other places applicable to ease the fuel shortage.

In brief summary given for cursive descriptive purposes only and not as limitation; the invention includes shaftmounted bimetallic element actuated flue-damper system having electric heater circuit controlling pivotal position of the flue damper, adjustably, and in failsafe synchronization with burner circuit.

The above and other objects and advantages of this invention will become more readily apparent upon examination of the following description, including the drawings, in which like reference numerals refer to like parts:

STRUCTURE

Figure 1:
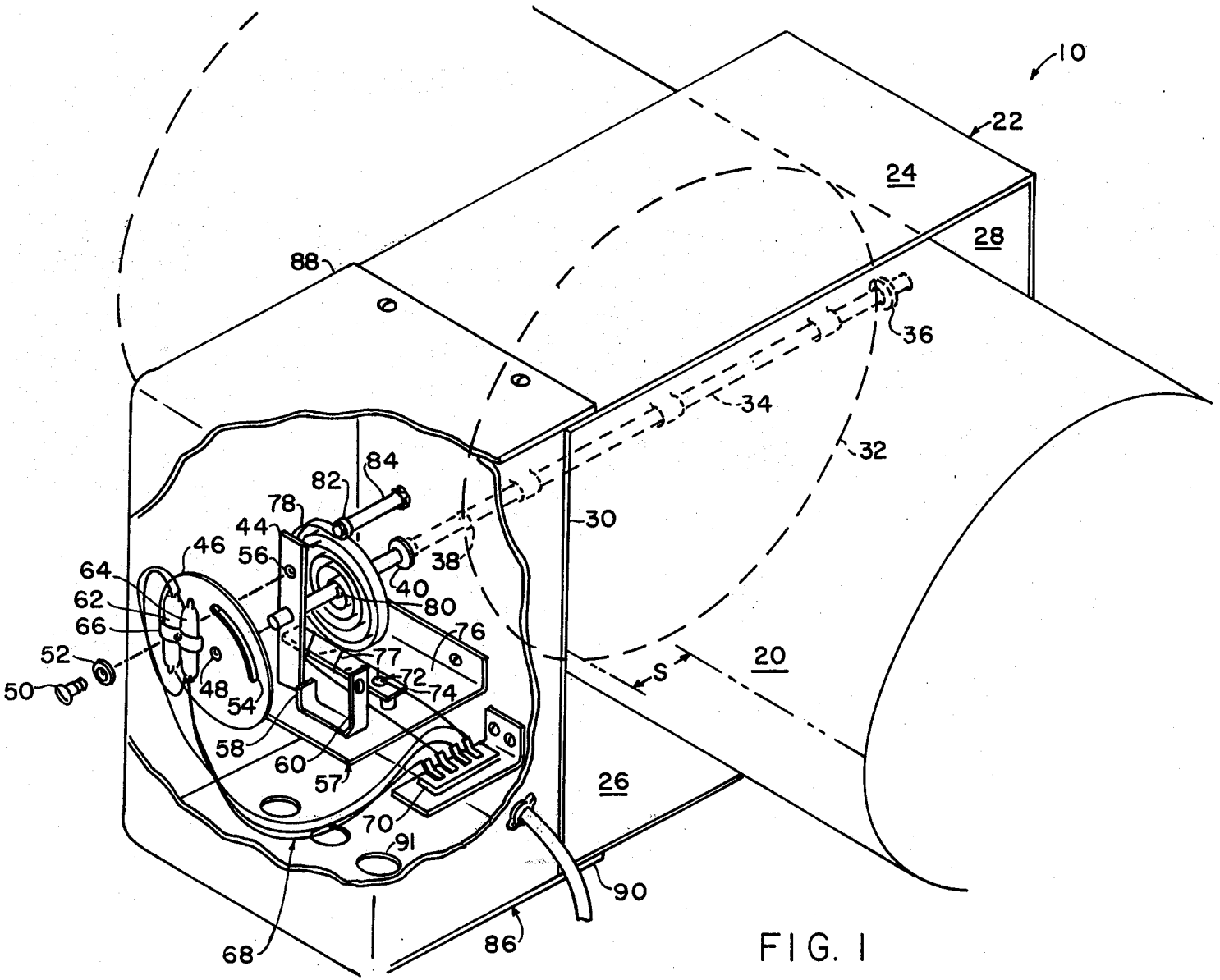
FIG. 1 is an isometric view of a first embodiment, partly exploded and with a portion removed for exposition.

FIG. 1 shows the invention as comprising a unitary assembly 10, including a short, straight length of ordinary cylindrical stovepipe or flue 20 to which is affixed a four-sided rectangular frame 22, the top 24 and bottom 26 and far side 28 of the frame being tangentially attached to the stovepipe as by spot welding, and the near side 30 having spacing S of at least one inch from the flue at the nearest point, providing for cooling ventilation and long-path conduction making the rigid standoff structure of the near side practically thermally independent of the flue for purposes of the invention.

Within the flue is a circular damper 32 coaxially mounted to it on a diametral axis by control rod 34 to which the damper may be clamped or welded and which has a bearing 36 at one end in the far wall of the flue and projects horizontally through clearance 38 in the near wall of the flue and through a second bearing 40 supported in side 30 of the rectangular frame.

Fixed near the end of the control rod like a propellor and outboard the bearing is a flat damper stop 44, and to this a switch disk 46 having a central hole 48 engaging the control rod is mounted adjustably in rotation by a clamp screw 50 which passes through a washer 52 and an arcuate concentric slot 54 in the switch disk and into threaded hole 56 in the damper stop.

Bracket 57 which extends from the frame beneath and parallel with the projection of control rod 34 supports first and second limits or stops 58, 60 in the path of the damper stop ends which project beyond the switch disk, limit rotary excursion of the control rod to 90°. At one limit the flue is closed and at the other limit fully open in alignment parallel with the flue axis.

One or two mercury switches, depending on type, are adjustably carried on the switch plate, two being shown as at 62, 64, for purposes of exposition of this embodiment, but both can be combined into one if desired, with built in angularoffset for purposes to be explained. Screw clamp 66 adjustably holds them to the switch disk and they adjust in rotation relative to the damper by means of the switch disk slot.

From the switches, leads of circuit 68 connect with a switch block 70 mounted on the frame, and leads of the circuit extend from the switch block, as will be described, to the furnace and also to an electric heater 72 comprising a low thermal mass insulative table 74 which may be of mica and screwed to the horizontal member 76 of the bracket, and wound with fine nichrome wire 77 or the like.

Above the heater, a coil, spiral, or helix 78 of bimetallic strip is conventionally affixed generally concentrically with the control rod at the inner end 80 of the spiral, as by welding, or by clamping in a slot in the control rod, and at the outer end 82 by looping around an elongate projection or post 84 fixed to the frame parallel with the control rod and projecting from the frame only as far as the spiral.

When it is desired not to use this system the resilient resistance of the spiral can be overcome and the loop on the end of the spiral can be slipped off the post permitting the control rod to be fixed at another position holding the damper open, as by clamping 44 to 60, or by tying these together.

A rectangular five-sided cover 86 attaches by projecting top 88 and bottom 90 to form a shield over the exposed parts of the invention, and has ventilation holes 91 in position promoting connection cooling of the heater and bimetallic spiral.

GENERAL DESCRIPTION OF OPERATION

In operation, after the furnace completes a heating cycle with predetermined time-delay to permit residual fumes to pass up the chimney flue but with much of the heat retained in the furnace, the damper 32 closes completely to the position shown. Damper closure retains in the furnace plenum for transfer with the heating system heat normally lost by convection up the flue and prevents down-draft chilling of the furnace.

Saving the customarily lost heat can save up to 25% or more of the fuel, depending on type furnace and operating conditions and efficiency of the furnace.

Failsafe provisions of the invention prevent premature closure of the damper, premature operation of the furnace at the beginning of the next cycle, and malfunction on breakage of the damper stop or limits. It will be seen from the following that even if the damper should become stuck in any position, except fully open, which is safe, the furnace could not turn on, thus eliminating the possibility of explosion or of fume leakage through back-pressure. Welded-contact problem encountered with hard contact switches are eliminated by use of mercury switches.

DETAILS OF OPERATION

The bimetallic spiral preferably "overcloses" or preloads about 25° at the fully closed position, through windup on installation according to this invention and within skill of anyone skilled in the art.

Starting from the fully closed position illustrated, to initiate a cycle, a signal from a thermostat or other demand signal closes a relay or the like sending current to the heater 72. The heater warms the bimetallic spiral which in turn rotates the control rod 34 and damper 32, and the damper stop 44 and switch disk or plate 46 with mercury switches, carried on the control rod.

The first mercury switch 62 is wired in series with the furnace burner circuit and according to the invention when it rotates 85° away from the damper-closed position, or to within 5° of the full damper-open position shown, it enables the furnace burner to turn on.

The second of the mercury switches, 64, is wired in series with the heater and when it rotates 86° away from the damper-closed position shown, or within 4° of the full damper-open position, it breaks the heater circuit.

Thermal lag causes the spiral to continue rotating the control rod in the damper opening direction until the damper stop 44 strikes the limit 60 at fully open position from which it slowly returns to the 86° position, starting the heater again. Thus the damper slowly oscillates between the 86° and 90° position during the time the furnace is required to operate, and by design tends to prevent the bearing from sticking and the damper from accumulating soot in the manner of static structures. Loss of effective flue area at the 86° position is negligible, being about 5% or less.

When demand for heat ceases as indicated by the thermostat or other conventional element, the circuit for the electric heater 72 shuts off, the bimetallic spiral slowly cools to permit flue gas purging and rotates the control rod to the damper-closed position. Time of cooling is made relatively independent of the flue temperature by design; cooling rate of the electric heater and spiral is set by the ventilative hole location, number and size, all easily within the adjustment skill of one skilled in the art in accordance with the invention, and by selection of the parts to have low thermal mass and only longpath conductive transfer with the flue. Ninety seconds to closure has been found satisfactory and easily attained with conventional structure.

WIRING DIAGRAM

Figure 2:
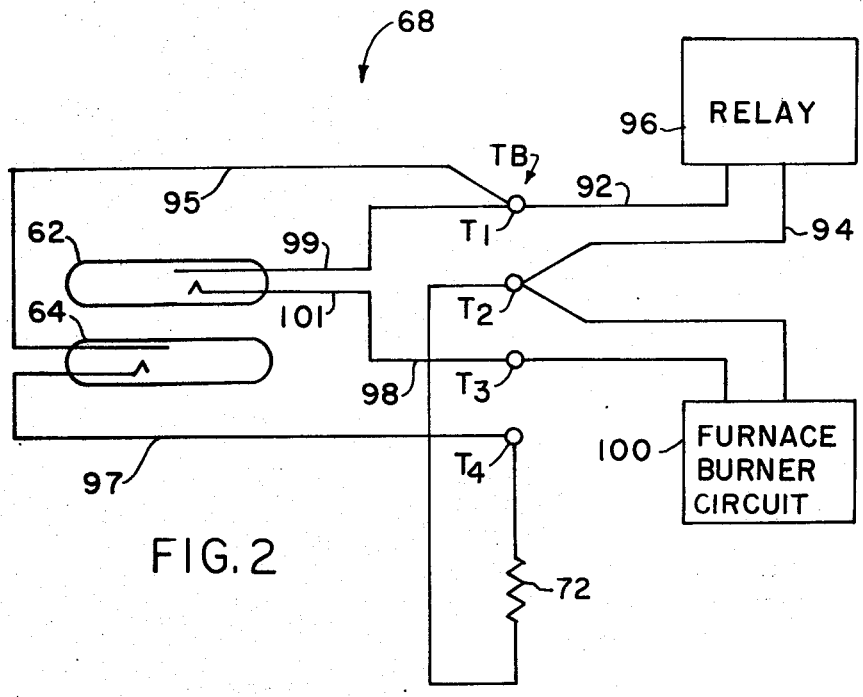
FIG. 2 is a wiring diagram for the first embodiment.

FIG. 2 shows the simplicity of the wiring required by the invention. In circuit 68, power lines 92 and 94, which may be from a 110 VAC source by way of a demand-responsive relay 96 or the like, connect by circuit wiring through $T_1$, 95, mercury switch 64, 97, $T_4$, through heater 72 and $T_2$. Similarly, power is supplied through $T_1$, 99, mercury switch 62, 101, $T_3$ furnace burner circuit 100, and $T_2$.

Figure 3:
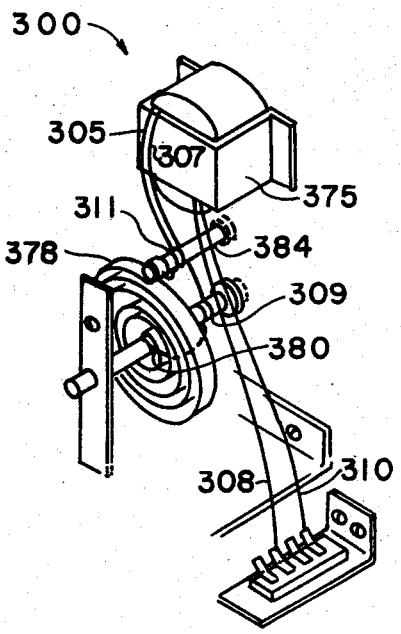
FIG. 3 is a fragmentary isometric detail of a second embodiment.

FIG. 3 shows an embodiment 300 like the first embodiment generally but with the preferred difference that the bimetallic spiral 378, which may be of any commonly coupled metals such as iron-Invar steel, is directly heated by resistance of the bimetallic spiral to current passed through it from a step-down transformer 375, supplied from the demand relay described in the previous Figure, through leads 305, 307 from the transformer secondary which may be soldered to the spiral. Leads 308, 310 are to the transformer primary. Post 384 is of insulative material such as micarta; a loose surplus winding of limp lead 309, 311 may be taken around the supporting structure to prevent constraint of the bimetallic spiral in windup at the inner end and in manual slip-off at the outer end. If desired, the junction at 380 may be insulated from the control rod by mica or by other conventional means.

Figure 4:
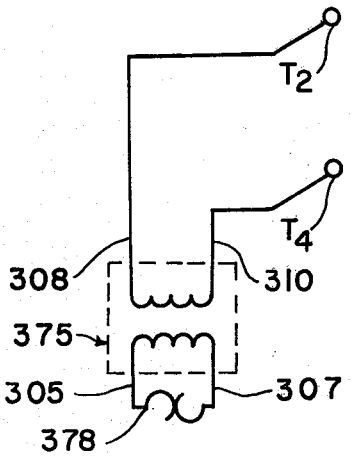
FIG. 4 is a fragmentary wiring diagram detail for the second embodiment.

FIG. 4 indicates that the wiring diagram for the second embodiment is the same as that for the first, the only change being deletion of the heater loop from $T_2$ to $T_4$ and substitution of the transformer primary leads 308, 310 and of the transformer secondary leads 305, 307 to the respective ends of the bimetallic spiral 378.

In conclusion, it will be appreciated from the foregoing that in this elementally simple system the damper is advantageously balanced on the control rod axis, a bearing at each end being substantially the only frictional force necessary to overcome, and that the helix or spiral of bimetallic strip and the switch disk and damper stop also act around this one axis, making installation and adjustment easy, reducing stress, and directly relating the positions of the damper with those of the switches and damper stop, enabling the user quickly to understand the principal and operation.

Wear of the bimetallic spiral is reduced to zero approximately, since it rubs on nothing, and because of system design of this and the other elements passage of years of operation should have little effect on smooth and reliable operation of the system, regardless of the duty cycle and temperature range of the furnace system in which installed; flue temperature, for example, can remain very high or can drop very low without substantially perturbing cycle time of the bimetallic spiral, or accelerating deterioration of the system wiring or switches.

The damper creates no pockets in the flue and deposits of carbon, if any, will tend to balance about the damper axis.

In this compact system taken as a whole, no parameters are critical; even if power fails the system efficiently and safely returns to the normally closed position until restored, the coiled or helix configuration providing for fast heating and cooling as a whole, increasing operating torque in both half cycles of operation, while providing easily established built-in delay as desired. The helix also eases stresses when the draft of the furnace blasts the damper, and cushions shock when the damper strikes either stop; preload is easy to increase in any reasonable amount desired by, for example varying coils from four to six in number, and in diameter.

The novel oscillation of the damper obtained by intermittent heating from the electric heater reduces power consumption, requires no counter balancing, and can be counted on to operate reliably, in part because of inter-reinforcement of the structures of the flue and frame. Heat build-up in the control system is positively prevented.

Gas erosion of the spiral is entirely prevented by location on the exterior of the sturdy but accessible frame structure, which makes all parts except the damper readily accessible; the parts are all simple and readily obtained.

The "overclosure" or pre-loading against the stop by the bimetallic strip at the fully closed position assures tight closure and builds-in a desirable time delay on opening, permitting the heater system and bimetallic strip to attain efficient thermal coupling before damper opening begins.

Finally, for two reasons, the damper also reduces the load on the air conditioning system during the summer months. First, it reduces the number of times the furnace must come on for systems with winter/summer hookup for hot water. Second, it prevents hot air from entering or leaving the home by the chimney, particularly when wind blowing across the chimney creates a draft, pulling from the home air which must be replaced by outside air, causing the air conditioner to run more often.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system for use with a furnace, including means for moving a damper in a flue length for isolating furnace from chimney flue during furnace-off cycle, with a bimetallic strip having heating means, and circuit means for enabling furnace operation in damper-open position and for preventing furnace operation in damper-closed position, the improvement comprising: said means for moving including: a control rod diametrally through the flue length mounting the damper coaxially in the flue length and having extension beyond the flue length, means rotatably mounting the control rod, the bimetallic strip being a coil with the inner end having connection to the control rod and the outer end having connection to the flue length for rotating the control rod from damper-closed position to damper-open position when heated by the heating means, and the circuit means including means for causing oscillation of the damper proximate the damper-open position.

2. In a system as recited in claim 1, the means for causing oscillation of the damper proximate the damper-open position comprising: means on the control rod for switching the heater off in response to a rotation of the control rod to a first angle proximate the damper-open position, and for switching the heater on at a second angle proximate the damper-open position less than the first angle relative damper-closed position.

3. In a system as recited in claim 2, said circuit means for enabling and preventing including means on the control rod for switching a furnace on at a third control rod angle less than but proximate to the second said control rod angle.

4. In a system as recited in claim 3, a switch plate adjustably mounting in rotation all said heater switching means and furnace switching means relative to the control rod.

5. In a system as recited in claim 4, means for stopping rotation of the control rod at the damper-closed position; and said bimetallic strip coil, when not heated by the heating means, pre-loading the control rod in rotation relative to the means for stopping at the damper-closed position.

6. In a system as recited in claim 5, a frame having a top and a bottom fixed to the flue length and an end between the top and bottom in spaced relation to the flue length, and said bimetallic strip coil connection with the flue length comprising an elongate member having attachment to the frame and projecting in spaced relation with the control rod.

7. In a system as recited in claim 6, a bracket fixed to the frame, the bracket comprising a part of the means rotatably mounting the control rod and including thereon said means for stopping rotation of the control rod at the damper-closed position, means on the bracket for stopping the control rod at the damper-open position, and said bracket supporting the heating means beneath the bimetallic-strip coil.

8. In a system as recited in claim 7, a cover having detachable mounting over all said extension, bimetallic-strip coil, switching means, bracket and heating means, the cover having ventilating openings therein proximate the heating means.

9. In a system as recited in claim 8, all said means for switching comprising mercury switch type structure.

10. In a system as recited in claim 9, a frame having a portion in fixed, spaced relation with the flue section, said elongate projection disposed generally parallel with the control rod and having supportive attachment to said frame portion.

11. In a system as recited in claim 6, the heating means comprising means for causing heating by flowing current through said bimetallic strip coil.

12. In a system as recited in claim 1, an elongate projection having fixed relation to the flue section comprising said bimetallic strip coil outer end connection with the flue section, the bimetallic strip coil outer end forming a slip-off detachable engagement with the elongate projection for preventing the bimetallic strip coil from rotating the control rod upon said detachment from the elongate projection.

* * * * *